US006578659B2

(12) United States Patent
Manna et al.

(10) Patent No.: US 6,578,659 B2
(45) Date of Patent: Jun. 17, 2003

(54) ULTRASONIC HORN ASSEMBLY

(75) Inventors: Ronald R. Manna, Valley Stream, NY (US); Dan Voic, Clifton, NY (US)

(73) Assignee: Misonix Incorporated, Farmingdale, NY (US)

( * ) Notice: Subject to any disclaimer, the term of this patent is extended or adjusted under 35 U.S.C. 154(b) by 68 days.

(21) Appl. No.: 09/728,410

(22) Filed: Dec. 1, 2000

(65) Prior Publication Data

US 2002/0068872 A1 Jun. 6, 2002

(51) Int. Cl.[7] ..... G08B 1/00; G10K 1/00

(52) U.S. Cl. ..... 181/142; 239/102.2; 73/1.83; 73/665; 422/128; 204/157.62

(58) Field of Search ..... 181/142, 175.181, 181/0.5; 601/2; 239/102.2, 102.1; 73/1.82, 1.83, 663, 665; 422/128; 204/157.62

(56) References Cited

U.S. PATENT DOCUMENTS 3,937,236 A 2/1976 Runnells
4,874,137 A * 10/1989 Chiba ..... 241/1
4,930,532 A 6/1990 Mayer
5,185,728 A 2/1993 Gilchrist
5,459,699 A 10/1995 Walter
5,779,985 A * 7/1998 Sucholeiki ..... 422/128
6,071,480 A 6/2000 Halaka
6,152,383 A * 11/2000 Chen ..... 128/200.16
6,277,332 B1 * 8/2001 Sucholeiki ..... 366/116

* cited by examiner

*Primary Examiner*—Robert E. Nappi
*Assistant Examiner*—Edgardo San Martin
(74) *Attorney, Agent, or Firm*—R. Neil Sudol; Henry Coleman; William Sapone

(57) ABSTRACT

An ultrasonic sonication device includes a velocity transformer or probe which, when coupled to a vibrating transducer of the piezoelectric or magnetostrictive type, resonates in sympathy with the transducer and either increases or decreases the magnitude of the transducer's vibration. A shallow cup assembly is attached to the distal end of the probe. The cup assembly holds a microtiter tray in a suitable orientation and contains an amount of liquid which provides efficient acoustic coupling between a transverse end face of the probe and the microtiter tray.

20 Claims, 5 Drawing Sheets

ULTRASONIC HORN ASSEMBLY

BACKGROUND OF THE INVENTION

This invention relates to ultrasonic vibration probes. More particularly, this invention relates to such an ultrasonic probe or horn assembly which is particularly useful in the simultaneous sonication of biological and cellular materials disposed in multiple wells of a tray.

It has been well known for decades that a probe which vibrates at ultrasonic frequencies (i.e. frequencies greater than 16,000 Hz) and has its distal end submerged under fluids will create cavitation bubbles if the amplitude of vibration is above a certain threshold. Many devices have been commercialized which take advantage of this phenomenon. An example of such an ultrasonic cellular disrupter is disclosed in the Sonicator™ sales catalog of Misonix Incorporated of Farmingdale, N.Y. In general, devices of this type include an electronic generator for producing electrical signals with frequencies ranging from 16 to approximately 100 KHz, a piezoelectric or magnetostrictive transducer to convert the signal to mechanical vibrations and a probe (a.k.a. horn or velocity transformer) which amplifies the motion of the transducer to usable levels and projects or removes the operating face away from the transducer itself. The design and implementation of these components are well known to the art.

The cavitation bubbles produced by such ultrasonic vibration devices can be utilized to effect changes in the fluid or upon particles suspended therein. Such changes include biological cell disruption, deagglomeration of clumped particles, emulsification of immiscible liquids and removal of entrained or dissolved gases, among many others.

Cell disruption has been a particularly good application for probe type devices, in that the cells may be disrupted without the heat or cellular changes which prevent further analysis by conventional methodology. Many scientific protocols have been written which name the Sonicator™ (or similar devices) as the instrument of choice for the procedure.

One characteristic of the probe type ultrasonic vibration devices which limit their use is the fact that the standard probes must be inserted directly into the fluid. Because the probe occupies volume as it is submersed, very small samples cannot be processed. In addition, the probe becomes contaminated with the fluid since the probe is in direct contact with the fluid. If the probe is subsequently dipped into another sample, contamination of that sample may occur. In some cases, this cross contamination renders the second sample unusable for analysis.

One way to mitigate these deficiencies is to have the probe tip separated from the sample by a membrane or other solid surface. If liquid is present on both sides of the membrane or surface, the acoustic waves will propagate through the membrane and transfer the cavitation forces to the second liquid volume without having the probe in direct contact with that second liquid volume. This membrane does not have to be elastic. In fact, experience shows that glass or hard plastic is an acceptable material. Consequently, glass and plastic test tubes and beakers are routinely used in this service. Misonix Inc. produces and sells a device called the Cup Horn™ which uses this method of acoustic wave transfer to allow the researcher to segregate the probe from the sample.

One requirement for use of the Cup Horn is that the beaker or test tube diameter be significantly smaller than the distal diameter of the Cup Horn probe itself. This allows the acoustic energy to be relatively uniform across the diameter of the sample container. In addition, liquid is forced to surround the entire probe end in order to provide the transfer fluid for the acoustic wave. FIG. 1 shows the relationship of the Cup Horn probe 12, transfer fluid 14 and sample test tube. A cup 16 having a cylindrical sidewall 18, an inwardly extending annular flange 20 and a cylindrical sleeve 22 is mounted to the horn or probe 12 via a coupling sleeve 24 and a pair of O-rings 26 disposed in a region about a node of ultrasonic vibration of the probe. The transfer fluid not only covers a transverse end face 28 of probe 12, but also surrounds a substantial portion of the cylindrical distal surface 30 of the probe.

The requirements of (a) the relative sizes of the probe 12 and the test tube and (b) the surrounding of the probe end surface 30 by the transfer fluid 14 give rise to at least two problems. First, the size of the vessel is limited to that of the surface area of the probe 12 and second, the liquid 14 surrounding the probe 12 places a great load upon the probe. The power required to overcome this load is many times that needed for acoustic coupling into the small sample. In some cases, as the probe has been made larger to accommodate larger samples, the energy required has become greater than the power capability of the electronic generators currently available. In such cases, system overloads have occurred.

These limitations become especially apparent when the sample vessel takes the form of a multi-well microtiter plate or tray. Such a plate is typically made from clear hard plastic such as polystyrene, polyvinylchloride or acrylics. The tray is fairly shallow and may contain up to approximately 96 depressions (wells) into which the samples or specimens are placed. Each depression may contain only a few microliters of sample. In most cases, the insertion of a probe device is problematic since each sample must be isolated from the others, the wells are too small and the total processing time would be an unacceptable multiple of the processing time of one cell. Therefore, most researchers would prefer a device which would isolate the samples from the ultrasound probe and process all cells simultaneously.

It would be obvious to most persons skilled in the art to simply enlarge the diameter of the probe to allow the entire tray to be covered. However, as previously stated, the probe becomes very large, leading to non uniformity in the vibrational amplitude of the distal surface, very high power requirements and high cost of manufacture. In the past, probes of smaller square section were made which allow a quarter of the tray to be processed at a time, which decreased processing time substantially. However, most researchers required a further reduction in time in order to process their entire workload in one day. Also, the outer edges of the trays received irregular ultrasonic energy and therefore inconsistent cell breakdown in successive samples.

OBJECTS OF THE INVENTION

An object of the present invention is to provide an ultrasonic device which could treat a full microtiter tray simultaneously.

Another object of the present invention is to provide such an ultrasonic device which increases the degree of uniformity of acoustic intensity across the cells of the microtiter tray.

A further object of the present invention is to provide such an ultrasonic device which does not heat the fluid or the sample liquids, and which require minimum energy to operate, thereby allowing the use of the device on existing laboratory scale ultrasonic processors.

These and other objects of the present invention will be apparent from the drawings and descriptions herein.

BRIEF DESCRIPTION OF THE INVENTION

The present invention is directed to an ultrasonic sonication device which includes two basic components, namely, (1) a velocity transformer (or probe) which, when coupled to a vibrating transducer of the piezoelectric or magnetostrictive type, resonates in sympathy with the transducer and either increases or decreases the magnitude of the transducer's vibration and 2) a shallow cup assembly which holds a microtiter tray in a suitable orientation and contains an amount of liquid which provides efficient acoustic coupling.

An ultrasonic horn assembly comprises, in accordance with the present invention, an ultrasonic horn or probe having an axis and a distal end with an end face oriented substantially transversely to the axis. The end face of the probe is disposed at least approximately at an antinode of ultrasonic vibration of the horn or probe. A cup member is attached to the horn or probe at least approximately at the antinode so as to define a liquid reservoir covering the end face of the horn or probe. This attachment of the cup member at, or approximately at, the antinode at the distal end of the probe enables the formation of the reservoir as a shallow reservoir covering essentially only the end face of the probe. A small or marginal circumferential surface of the probe, contiguous with the end face thereof, may be submerged in the coupling liquid, as well.

In an ultrasonic horn assembly in accordance with the present invention, the load placed upon the probe is decreased owing to the reduction in the area of contact between the coupling fluid and the probe. The power requirements are accordingly reduced for a probe end face of a given area.

The cup member is attached to the horn or probe via a flexible coupling element such as an O-ring or an annular elastomeric membrane. Where the cup member includes a sidewall and a lower wall or flange extending inwardly from the sidewall, the lower wall is provided with at least one port for feeding liquid to the reservoir. Preferably, the port is one of at least a pair of ports disposed on substantially opposite sides of the cup member. The feeding of the coupling liquid through a lower wall of the cup member has advantages detailed below.

The end face of the probe is disposed in a first plane and an upper surface of the flange is disposed in a second plane spaced a first predetermined distance from the first plane, so that a lower surface of a specimen-containing tray resting on the upper surface of the flange is spaced a second predetermined distance from the probe end face. This spacing optimizes the acoustic effects of the ultrasonic energy on specimens contained in wells of a microtiter tray. To enable an optimal spacing, the probe end face is provided with a plurality of grooves for receiving peripheral lower edges of the tray so that contact between the tray and the vibrating probe is prevented.

Where the end face of the probe is circular, the end face has a diameter larger than a largest dimension of the portion of the tray containing the sample wells. Thus, all of the sample wells are located over the end face of the probe.

In accordance with another feature of the present invention, the probe is provided at the distal end, proximately to the end face, with an annular concavity for providing or enhancing uniformity of the ultrasonic wave field generated in the coupling fluid reservoir.

An ultrasonic sonication device in accordance with the present invention is an effective apparatus to acoustically treat or disrupt samples within a multiwell microtiter tray.

DESCRIPTION OF THE PREFERRED EMBODIMENTS

Figure 2:
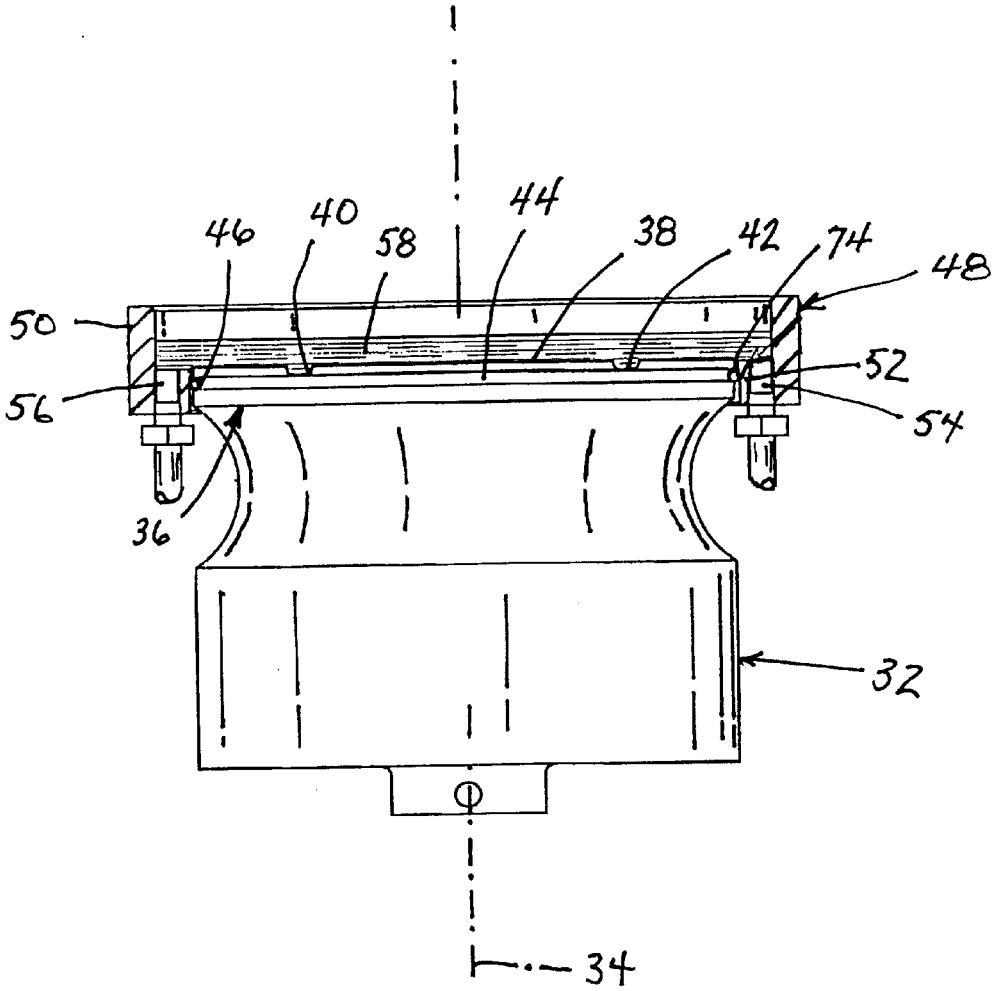
FIG. 2 is a cross-sectional view, taken along an axial plane, of an ultrasonic sonication device in accordance with the present invention.

As illustrated in FIG. 2, an ultrasonic sonication device comprises a horn or probe 32 having an axis 34 defining a direction of ultrasonic standing wave propagation. Probe 32 has a distal end portion 36 formed with an active end face 38 oriented transversely to axis 34 and provided with at least one pair of parallel grooves 40 and 42. Distal end portion 36 of probe 32 is further formed with an annular groove 44 receiving an elastomeric O-ring seal 46.

The ultrasonic sonication device of FIG. 2 additionally comprises a cup member 48 having a vertical cylindrical sidewall 50 and a horizontal annular flange 52 extending inwardly from a lower end of the sidewall. An inner periphery of flange 52 is in fluid tight contact with an outer periphery of distal horn portion 36, through or over O-ring seal 46. Flange 52 is provided on opposite sides with a pair of liquid ports or fittings 54 and 56 for the continuous introduction and removal, respectively, of a pressure-wave transfer fluid 58 from a reservoir defined in part by probe end face 38 and cup member 48.

Figure 3:
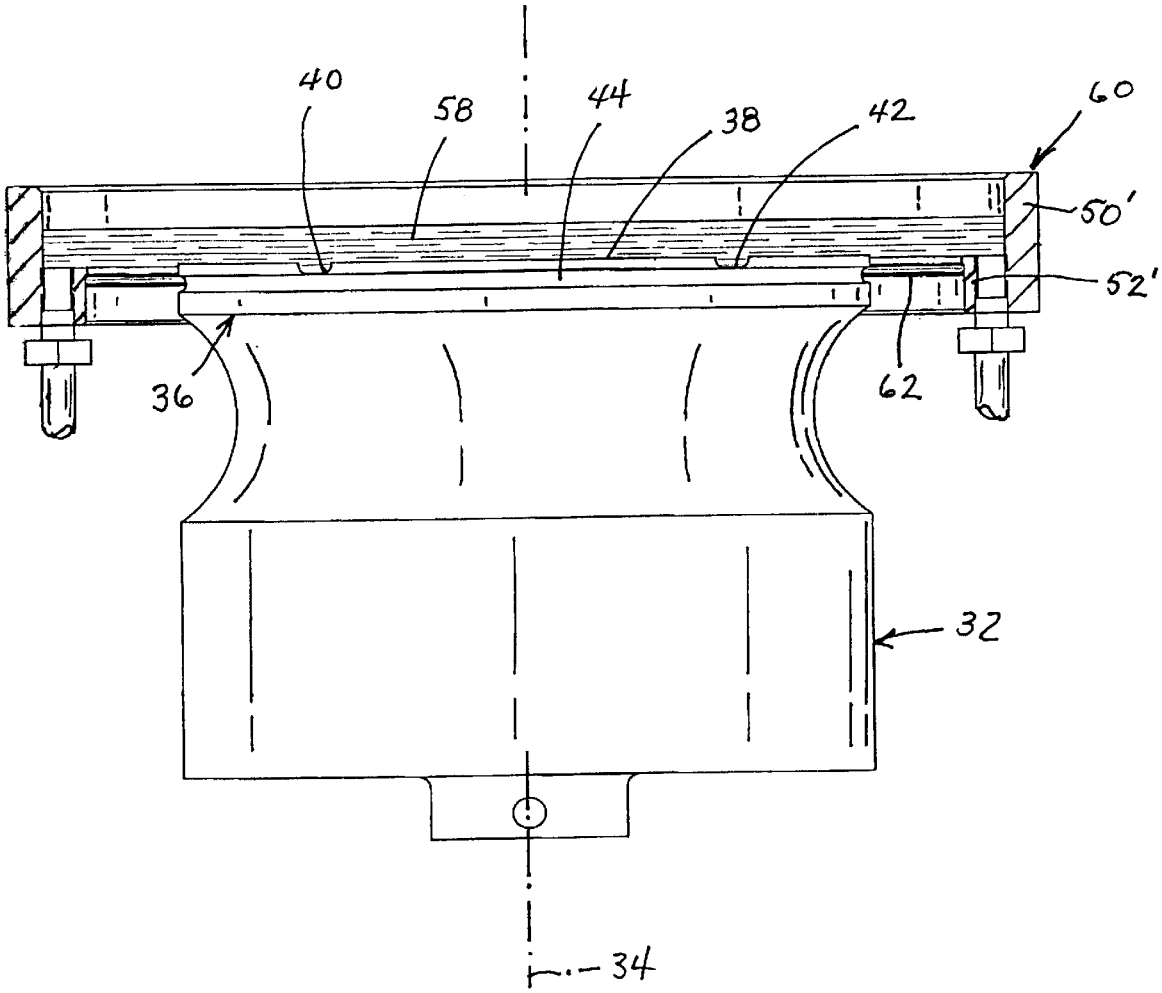
FIG. 3 is a cross-sectional view, taken along an axial plane, of another ultrasonic sonication device in accordance with the present invention.

As depicted in FIG. 3, a modified ultrasonic sonication device comprises a cup member 60 having a sidewall 50' with a larger diameter than sidewall 50 of cup member 48. An inner periphery of an annular flange 52' is spaced from and connected to the outer periphery of distal horn portion 36 by an annular elastomeric membrane 62. Membrane 62 is sealingly fixed along an inner side to distal horn portion 36 and along an outer side to flange 52'.

Figure 4:
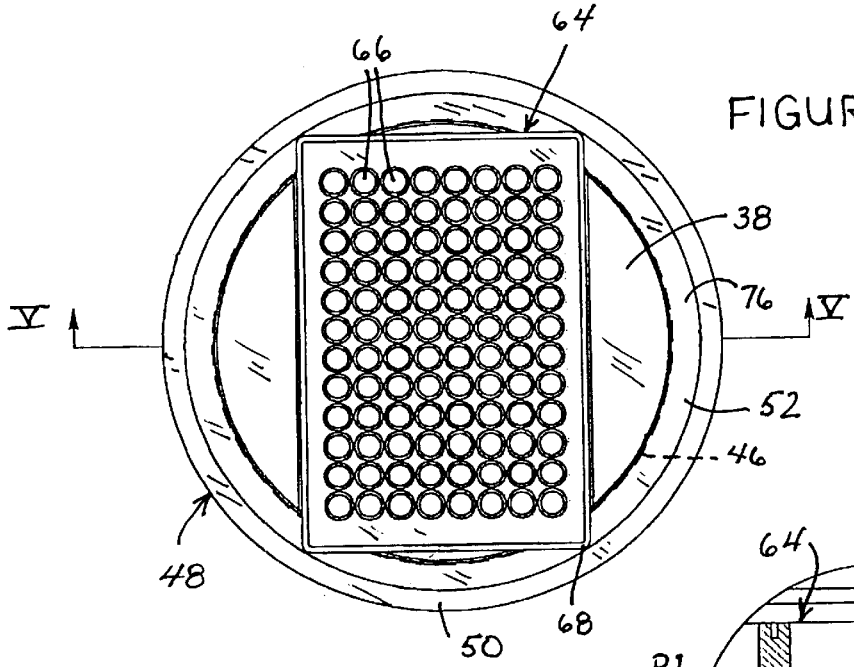
FIG. 4 is a top plan view of the ultrasonic sonication device of FIG. 2, showing a microtiter tray in place on the probe.
Figure 6:
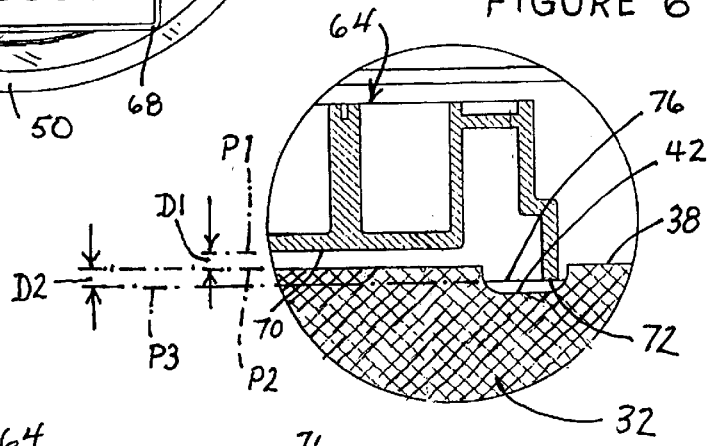
FIG. 6 is a detail, on a larger scale, of a portion VI of FIG. 5.
Figure 5:
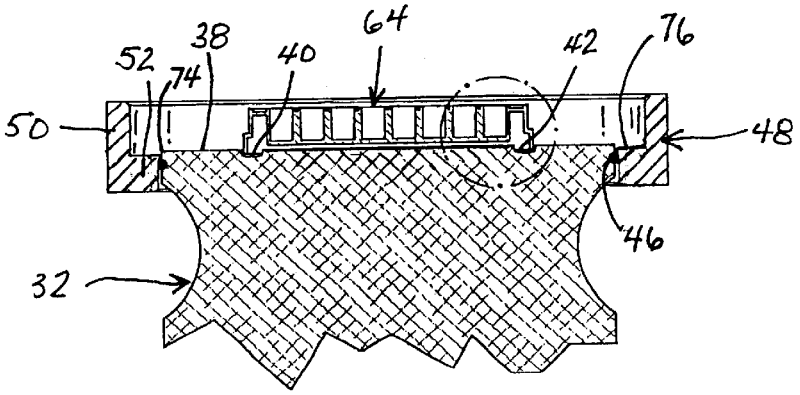
FIG. 5 is a partial cross-sectional view taken along line V—V in FIG. 4.

FIGS. 4, 5, and 6 depict the use of the sonication device of FIG. 2 with a microtiter tray or plate 64 having a plurality of specimen-receiving wells or cells 66 disposed in a rectangular array. Four corners 68 of tray 64 rest on flange 52 so that a bottom surface 70 (FIG. 6) of the tray is disposed in a plane P1 spaced a predetermined distance D from a plane P2 in which the vibrating end face 38 of probe 32 is located. This distance D is selected to optimize the transmission of ultrasonic wave energy from end face 38 through fluid 58 and into tray 64.

Tray 64 is conventionally configured to have a peripheral lower rim 72 (FIG. 6) which extends below the plane P1 of bottom tray surface 70. This rim 72 is in contact with an upper surface 76 (FIGS. 4–6) of flange 52 and is spaced from horn or probe 32 by virtue of grooves 40, 42, etc., provided in end face 38.

Probe 32 functions in part as a velocity transformer which amplifies the motion of a piezoelectric or magnetostrictive transducer (not shown) to usable levels. Probe 32 can be designed and constructed using standard techniques known to the art. However, several important operating characteristics must be obtained for probe 32 to be useful in this device. First, distal end face 38 of probe 32 must be large enough to cover the entire area of bottom surface 70 of microtiter tray 64. In the embodiment described herein, distal end face 38 is circular and has a diameter of 5.25 in., but other diameters or geometric shapes may be employed as well. One important aspect regarding size is that microtiter tray wells 66 must not be less than 0.125 inches from an outer edge 74 of probe end face 38. If a tray cell 66 is located at edge 74 or within 0.125 inches of that edge, acoustic input to the well will be decreased due to ultrasonic edge effects. Second is that it is advantageous if a uniform amplitude of vibration is generated across the entire end face 38 of probe 32. If significantly non-uniform vibrations are present, then non-uniformity of processing in the microtiter wells 66 will result. In order to obtain this uniform vibration for the size of probe discussed herein, the shape of probe 32 must be as that shown in FIG. 2. It should be noted that the dimensions given describe a probe 32 which has a fundamental resonant frequency of approximately 20 kc. Other frequencies of operation may be employed without deviating from the scope of this disclosure.

Grooves or reliefs 40, 42, etc., are machined or otherwise formed in probe end face 38 (FIG. 6) to allow microtiter tray edge or rim 72 to sit in these recesses. In this way, the bottom surface 70 of microtiter tray 64 sits within 0.100 inches (preferably between about 0.001 and 0.100 inches) of the vibrating probe end face 38. Controlling this distance D is of paramount importance if enough acoustic energy is to be transmitted through the wall of tray 64 to the samples contained in wells or cells 66 thereof. The geometry of probe end face 38 is particularly shown in FIGS. 4–6. Of course, probe 32 must be manufactured from an acoustically efficient material such as aluminum, titanium, certain stainless steels and certain ceramics. These materials are all known to the art. Harder materials such as titanium or ceramics will yield a device which does not wear quickly due to cavitation erosion. Connection to the transducer (not shown) can be accomplished by a threaded stud (not shown) or other techniques well known to the art.

Figure 1:
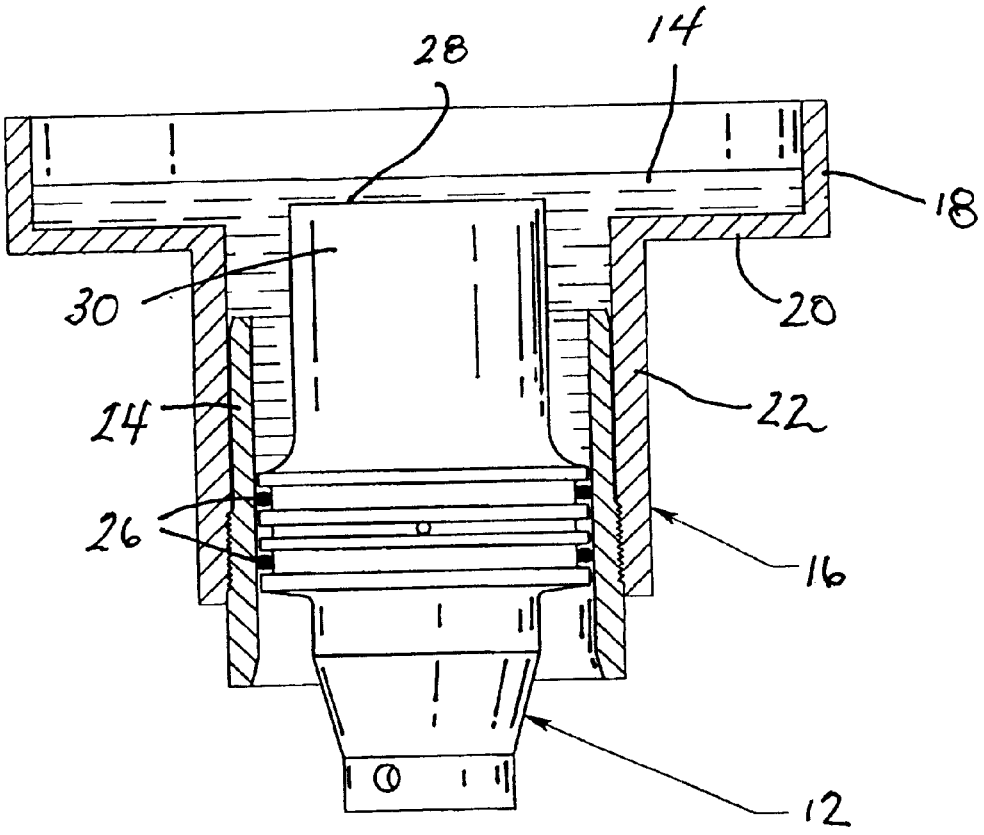
PRIOR ART FIGURE 1
FIG. 1 is a cross-sectional view, taken along an axial plane, of an ultrasonic sonication device in accordance with the prior art.

The seal provided by O-ring 46 or membrane 62 is elastomeric to provide a compliant joint between cup member 48 or 60 and probe 32. This seal is liquid tight and yet isolates cup member 48 or 60 from the vibrations transmitted by probe 32. This isolation prevents loading and possible detuning of probe 32 while keeping acoustic power from being absorbed by cup member 48 or 60, preventing melting thereof if the cup member is manufactured from thermoplastics. It is to be noted that O-ring 46 and membrane 62 are placed at or near an anti-node (point of maximum displacement) of probe operation as opposed to being placed at a node (point of no displacement) as is generally practiced by the art. Since the node point is found approximately at the midpoint of probe 12 (see FIG. 1), placing the seal at the node would mean that half of the probe would be submerged under cooling/coupling fluid 14. Prior art, as shown in FIG. 1, uses the node point sealing method, with all of the inherent problems as described above. Moving the seal position near the antinode (and thus near probe end face 28) greatly reduces the power loading and energy consumption of the device.

Cup members 48 and 60 are fabricated alternatively from clear acrylic and clear polyvinylchloride. However, other materials such as thermoplastics, metals, ceramics or thermosets may be used with equal results.

Several features of cup member 48 and 60 are important to the operation of the device. First, cup members 48 and 60 must have an internal diameter just slightly greater than the diagonal dimension of the microtiter tray 64. This centers the tray 64 with respect to the end face 38 of probe 32, as shown particularly in FIG. 4. Upper surface 76 of flange 52, 52' must be designed in conjunction with the dimensions of microtiter tray 64 in order to hold the tray off the probe end face 38 by the proper distance D. To that end, a plane P3 in which surface 76 is disposed is located at a predetermined distance D2 (FIG. 6) from the plane P2 of probe end face 38. Microtiter tray 64 sits on cup surface 76 and does not contact probe 32 at any point. If tray 64 is allowed to touch end face 38 of the probe, melting of the tray will result.

Figure 7:
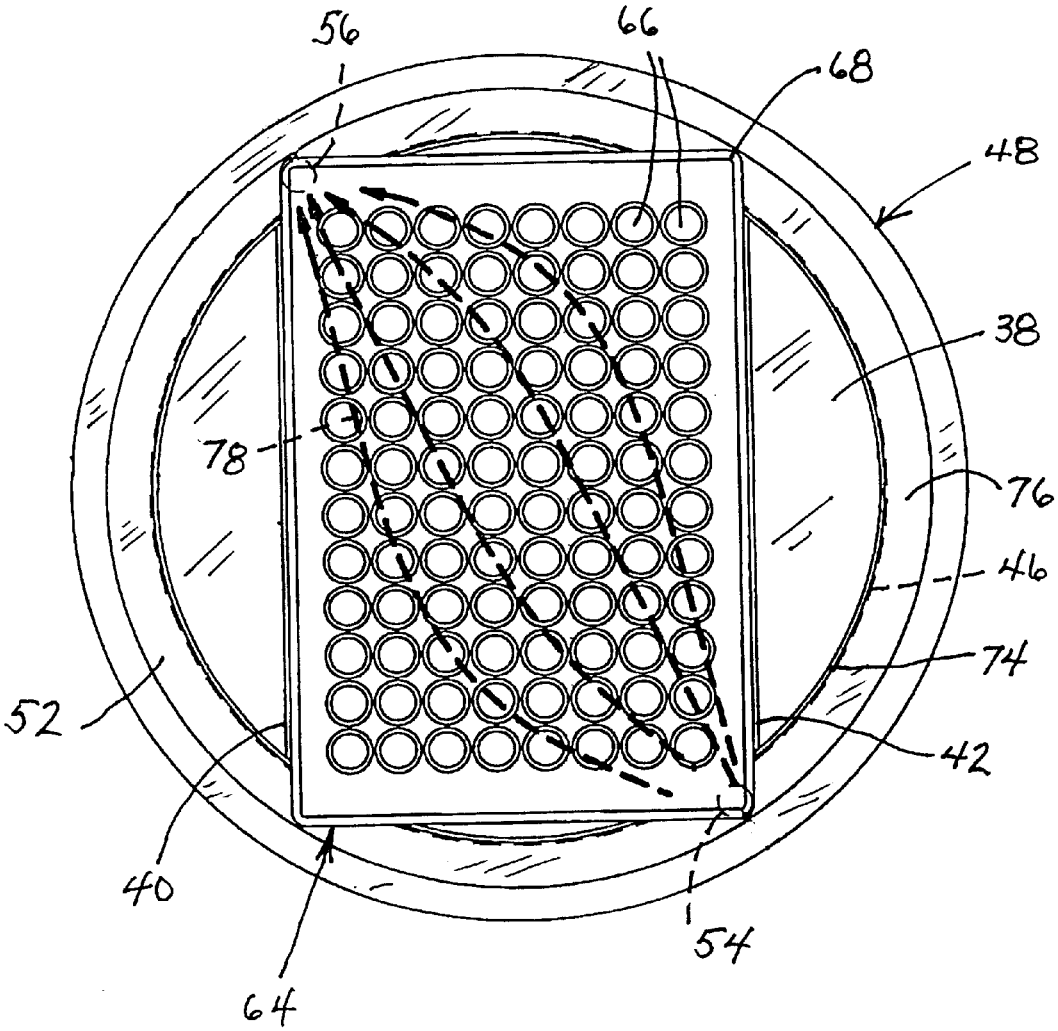
FIG. 7 is an enlarged top plan view similar to FIG. 4, showing flow paths for a transfer fluid.

Next, cup member 48 or 60 must incorporate liquid fittings or ports 54 and 56, to allow coupling fluid 58 to be pumped in and out of the cup member. If fluid transport is not provided, then heating of the fluid will result with extended use. The temperatures generated may exceed the cytocoagulation temperature of the biological samples in wells 66, effectively cooking the specimens. A constant flow of fresh or cooled fluid obviates this eventuality. Although the necessity for cooling is well known to the art, an improvement disclosed herein is to place the fittings 54 and 56 so that the coupling fluid or liquid 58 is introduced and removed from under the microtiter tray 64. FIG. 7 shows general paths 78 of fluid flow under microtiter tray 64 from one port or fitting 54 to the other port 56. When the ports or fittings 54, 56 are disposed on opposite sides of cup member 48, 60 and along flanges 52, 52' thereof, the coupling fluid 58 has maximum cooling effect and reduces or eliminates splashing onto the top of the tray 64, thereby preventing contamination of the samples. Another benefit is extremely important in that the liquid flow as illustrated in FIG. 7 will purge or flush trapped air from the underside or bottom surface 70 of tray 64. Air bubbles, if present between the probe end face 38 and the bottom surface 70 of the tray 64, will not allow acoustic coupling to the tray wells 66 and no processing will result. Therefore, bubbles or air entrapment must be eliminated, something which this embodiment accomplishes. In the disclosed embodiment, port elements 54, 56 are standard liquid tubular fittings provided on the lower surface of the cup member 48, 60. The coupling fluid or liquid can be plain tap water, saline, distilled water or, if sub freezing temperatures are desired, a solution of glycol and water may be employed.

In operation, a thin plastic film (not shown) should be applied to the top of microtiter tray 64 in a fashion known to the art. This thin film prevents loss of samples from the tray wells 66 during acoustic processing, from either bubbling or atomization. In addition, cross contamination of samples is eliminated. Although when using non-ultrasonic techniques of sample preparation, this film is optional, the film is deemed essential in use of the ultrasonic sonication devices disclosed herein.

Cup member 48, 60 must incorporate features such as a counterbore to prevent slippage of the cup relative to probe 32. This prevents the cup from lowering with respect to the probe end face 38 and maintains the clearance between the bottom surface 70 of microtiter tray 64 and the probe end face.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An ultrasonic horn assembly comprising:

an ultrasonic horn or probe having an axis and a distal end with an end face oriented substantially transversely to said axis, said end face being disposed at least approximately at an antinode of ultrasonic vibration of said horn or probe; and a cup member attached to said horn or probe at least approximately at said antinode so as to define a liquid reservoir covering said end face of said horn or probe.

2. The assembly defined in claim 1 wherein said cup member is attached to said horn or probe via a flexible coupling element.

3. The assembly defined in claim 2 wherein said coupling element is taken from the group consisting of an elastomeric O-ring and an elastomeric membrane.

4. The assembly defined in claim 1 wherein said cup member includes a sidewall and a lower wall or flange extending inwardly from said sidewall, said lower wall being provided with at least one port for feeding liquid to said reservoir.

5. The assembly defined in claim 4 wherein said port is one of at least a pair of ports disposed on substantially opposite sides of said cup member.

6. The assembly defined in claim 1 wherein said cup member includes a sidewall and a lower wall or flange extending inwardly from said sidewall, said end face being disposed in a first plane and an upper surface of said flange being disposed in a second plane spaced a first predetermined distance from said first plane, so that a lower surface of a specimen-containing tray resting on said upper surface of said flange is spaced a second predetermined distance from said end face.

7. The assembly defined in claim 6 wherein said end face is provided with a plurality of grooves for receiving peripheral lower edges of said tray.

8. The assembly defined in claim 6 wherein said end face is circular and has a diameter larger than a largest dimension of a portion of said tray containing specimens.

9. The assembly defined in claim 1 wherein said reservoir covers essentially only said end face of said horn or probe.

10. The assembly defined in claim 1 wherein said probe is provided at said distal end, proximately to said end face, with an annular concavity.

11. An ultrasonic horn assembly comprising:

an ultrasonic horn or probe having an axis and a distal end with an end face;

a cup member attached to said horn or probe at least approximately at said antinode so as to define a liquid reservoir covering at least said end face of said horn or probe, said cup member having a sidewall and a lower wall or flange extending inwardly from said sidewall; and at least one port provided in said lower wall or flange for feeding liquid to said reservoir.

12. The assembly defined in claim 11 wherein said cup member is attached to said horn or probe via a flexible coupling element.

13. The assembly defined in claim 12 wherein said coupling element is taken from the group consisting of an elastomeric O-ring and an elastomeric membrane.

14. The assembly defined in claim 11 wherein said end face is disposed in a first plane and an upper surface of said flange is disposed in a second plane spaced a first predetermined distance from said first plane, so that a lower surface of a specimen-containing tray resting on said upper surface of said flange is spaced a second predetermined distance from said end face.

15. The assembly defined in claim 14 wherein said end face is provided with a plurality of grooves for receiving peripheral lower edges of said tray.

16. The assembly defined in claim 15 wherein said end face is circular and has a diameter larger than a largest dimension of a portion of said tray containing specimens.

17. The assembly defined in claim 11 wherein said port is one of at least a pair of ports disposed on substantially opposite sides of said cup member.

18. The assembly defined in claim 11 wherein said cup member is attached to said horn or probe in a region about an antinode of said horn or probe.

19. The assembly defined in claim 11 wherein said reservoir covers essentially only said end face of said horn or probe.

20. The assembly defined in claim 11 wherein said probe is provided at said distal end, proximately to said end face, with an annular concavity.

* * * * *